US012054316B2

(12) United States Patent
Yu

(10) Patent No.: US 12,054,316 B2
(45) Date of Patent: Aug. 6, 2024

(54) TAMPER EVIDENT CONTAINER CAP METHOD AND APPARATUS

(71) Applicant: Cap-Thin Molds Inc., Mississauga (CA)

(72) Inventor: David Yu, Mississauga (CA)

(73) Assignee: CAP-THIN MOLDS INC., Mississauga (CA)

( * ) Notice: Subject to any disclaimer, the term of this patent is extended or adjusted under 35 U.S.C. 154(b) by 315 days.

(21) Appl. No.: 17/385,195

(22) Filed: Jul. 26, 2021

(65) Prior Publication Data

US 2022/0024649 A1 Jan. 27, 2022

Related U.S. Application Data

(60) Provisional application No. 63/056,086, filed on Jul. 24, 2020.

(51) Int. Cl.
*B65D 41/34* (2006.01)

(52) U.S. Cl.
CPC ..... *B65D 41/3428* (2013.01)

(58) Field of Classification Search
CPC ..... B65D 41/3428; B65D 41/3447; B65D 41/3457; B65D 1/0246
USPC ..... 215/252, 305, 307, 329, 343–344, 337
See application file for complete search history.

(56) References Cited

U.S. PATENT DOCUMENTS 3,235,115 A 2/1966 Duke
4,352,436 A * 10/1982 Chartier ..... B65D 41/3452 215/252
4,527,705 A * 7/1985 Prades ..... B65D 41/3447 215/341
4,529,096 A * 7/1985 Chartier ..... B65D 41/3452 215/250
4,549,667 A * 10/1985 Dullabaun ..... B65D 41/3447 215/253
4,550,843 A * 11/1985 Nolan ..... B65D 41/3452 215/321
4,572,387 A * 2/1986 Luker ..... B65D 41/3452 215/252

(Continued)

FOREIGN PATENT DOCUMENTS

EP 1151932 A1 11/2001
EP 3152122 B1 4/2019

(Continued)

*Primary Examiner* — Chun Hoi Cheung
*Assistant Examiner* — Brijesh V. Patel
(74) *Attorney, Agent, or Firm* — BERESKIN & PARR LLP/ S.E.N.C.R.L., s.r.l.

(57) ABSTRACT

A cap for a container includes an annular tamper evident band with a generally rigid cylindrical frame having an upper ring and a plurality of ribs extending axially from the ring and spaced circumferentially apart about the ring. A plurality of retainer elements are supported by the frame, each retainer element connected at circumferentially opposed ends by resiliently flexible webs to adjacent ones of the ribs. The retainer elements are biased to a radially contracted position, in which the retainer elements protrude inwardly to engage an underside surface of a neck flange of the container. The retainer elements are movable to a radially expanded position in which the retainer elements can be advanced axially past the neck flange when installing the cap onto the container for the first time.

20 Claims, 6 Drawing Sheets

(56) References Cited

U.S. PATENT DOCUMENTS 4,753,360 A * 6/1988 Baxter ..... B65D 41/3447 215/252
4,848,614 A * 7/1989 Csaszar ..... B65D 41/3428 220/268
4,913,300 A * 4/1990 Wiedmer ..... B65D 41/3447 215/252
4,915,244 A 4/1990 Celaschi et al.
4,984,701 A * 1/1991 Margaria ..... B65D 41/3447 215/256
5,131,550 A * 7/1992 Thompson ..... B65D 41/3447 215/252
5,197,619 A * 3/1993 Margaria ..... B65D 41/3442 215/256
5,402,901 A * 4/1995 Carvalheiro ..... B29C 45/44 215/252
5,413,235 A * 5/1995 Decelles ..... B65D 41/3447 215/252
5,570,798 A * 11/1996 Hayashida ..... B65D 41/3428 215/252
5,609,263 A * 3/1997 Perchepied ..... B65D 41/3447 215/DIG. 1
5,648,037 A * 7/1997 Franchet ..... B65D 41/3447 264/296
5,755,346 A * 5/1998 Ekkert ..... B65D 41/3447 215/901
5,775,527 A * 7/1998 Bosl ..... B65D 41/3428 215/252
5,819,965 A * 10/1998 King ..... B65D 41/3409 215/252
5,836,468 A * 11/1998 Bosl ..... B65D 41/48 220/795
6,089,390 A * 7/2000 Druitt ..... B65D 41/3447 215/307
6,325,227 B1 * 12/2001 Ekkert ..... B65D 41/3447 215/258
6,568,548 B1 * 5/2003 Minnette ..... B65D 41/3428 215/258
8,393,483 B2 * 3/2013 Druitt ..... B65D 41/04 215/344
9,902,530 B2 2/2018 Smith et al.
2004/0069738 A1 * 4/2004 Orth ..... B65D 41/3447 215/252
2005/0167389 A1 * 8/2005 Price ..... B65D 41/3428 215/252
2008/0087625 A1 * 4/2008 Kumata ..... B65D 41/0485 215/252
2013/0270272 A1 10/2013 Smith et al.
2015/0069007 A1 * 3/2015 Ekkert ..... B65D 41/3428 215/252
2017/0050773 A1 * 2/2017 Rognard ..... B65D 47/0804
2018/0134462 A1 5/2018 Dreyer et al.

FOREIGN PATENT DOCUMENTS

GB 2022063 A 12/1979
WO 2015185465 A1 12/2015

* cited by examiner

TAMPER EVIDENT CONTAINER CAP METHOD AND APPARATUS

CROSS-REFERENCE

This application claims the benefit of Provisional Application Ser. No. 63/056,086, filed Jul. 24, 2020, which is hereby incorporated herein by reference.

FIELD

The specification relates generally to apparatuses and methods associated with container caps, and more specifically, to a tamper evident container cap.

The specification relates generally to apparatuses and methods associated with container caps, and more specifically, to a tamper evident container cap.

BACKGROUND

U.S. Pat. App. No. 2018/0134462 ("Dreyer") purports to disclose a closure for a container, the closure comprising a top panel, a skirt extending from the periphery of the top panel, and a tamper indicating band frangibly connected to an open end of the skirt at a line of weakness, the band including a retaining segment on an inner surface thereof so arranged, when the closure is in a closed position on a neck of the container, to engage under an engagement surface of a retaining structure arranged on the container neck, wherein the tamper indicating band includes at least one indent arranged on an outer surface of the tamper indicating bond.

U.S. Pat. No. 9,902,530 ("Smith") purports to disclose a closure, especially a closure for packages for liquids such as beverages. In particular the invention relates to a closure for containers for carbonated liquids such as soft drinks. The closure comprises an outer shell with a reduced weight and a sealing means which actively compensates the deformation of the outer shell to avoid loss of performance.

U.K. Pat. App. No. 2,022,063 ("Carreras") purports to disclose a plastic screw cap comprising a security ring attached to a skirt by relatively weak connecting bridge portions, the cap provided with a pair of shoulders, one of the surfaces of each being disposed substantially normal to the axis of the screw cap so as to provide a pair of support surfaces for cooperation with stripping elements during ejection of the cap from an injection mold, without producing stresses capable of rupturing the connecting bridge portions. The mold is designed so as not to require mold members transversally moveable relative to the axis thereof for stripping operations.

SUMMARY

The following summary is intended to introduce the reader to various aspects of the applicant's teaching, but not to define any invention.

According to some aspects, a cap for a container includes a main cap body including an annular sidewall extending along an axis, the annular sidewall having a sidewall upper end adjacent a cap upper end closed by a top panel and an open sidewall lower end opposite the top panel; an annular tamper evident band disposed about the axis and adjacent the sidewall lower end, the tamper evident band including a generally rigid cylindrical frame having an upper ring at a frame upper edge frangibly connected to the sidewall lower end, a plurality of ribs circumferentially spaced from one another about the axis and extending from the upper ring to a frame lower end opposite the frame upper end, and the tamper evident band including a plurality of retainer elements secured to the frame and movable relative to the frame between an expanded position and a contracted position, wherein when in the expanded position, the retainer elements are disposed radially outwardly relative to the contracted position to facilitate axial advancement of the tamper evident band past a container neck flange when first installing the cap on the container, and when in the contracted position, the retainer elements protrude radially inwardly relative to the expanded position to engage an underside surface of the container neck flange and prevent axial withdrawal of the tamper evident band from the container when the cap main body is removed from the container for the first time.

In some examples, the retainer elements are circumferentially spaced from one another about the axis in alternating arrangement with the plurality of ribs, each retainer element disposed between a first adjacent rib and a second adjacent rib of the plurality of ribs, and each retainer element joined at a retainer first end to the first adjacent rib by a first resiliently flexible connecting web and at a retainer second end circumferentially opposite the retainer first end to the second adjacent rib by a second resiliently flexible connecting web.

In some examples, each retainer element is biased to the contracted position and movable between the expanded and contracted positions by resilient expansion and contraction of the first and second resiliently flexible connecting webs.

In some examples, the plurality of retainer elements define a retainer element first inner diameter when in the contracted position and a retainer element second inner diameter when in the expanded position, the retainer element first inner diameter less than the neck flange outer diameter for engaging an underside surface of the neck flange when in the contracted position, and the retainer element second inner diameter greater than the neck flange outer diameter when in the expanded position.

In some examples, the tamper evident band is connected to the sidewall lower end of the cap main body by a plurality of frangible bridges spaced apart circumferentially about the axis. In some examples, each frangible bridge of the plurality of frangible bridges is circumferentially aligned with a respective rib of the plurality of ribs.

In some examples, the cylindrical frame has a frame inner diameter larger than a neck flange outer diameter of the container neck flange.

In some examples, the cylindrical frame includes a lower ring extending about the circumference, each rib of the plurality of ribs extending from the upper ring to the lower ring to join the upper and lower rings together. In some examples, a lower end of each retainer element is joined to the lower ring.

In some examples, the retainer element first inner diameter is smaller than the frame inner diameter by at least 0.8 millimeters.

In some examples, the retainer element first inner diameter is smaller than the frame inner diameter by about 1.25 millimeters.

In some examples, each retainer element further comprises a resiliently flexible upper web joining an axially upper edge of the retainer element to the upper ring.

In some examples, the resiliently flexible upper web includes an upper portion and an adjoining lower portion, the upper portion extending axially and the lower portion extending radially when the retainer element is in the expanded position and the upper portion and the lower portion forming an acute angle when the retainer element is in the contracted position.

In some examples, the cylindrical frame includes a plurality of abutments at the frame upper end, the plurality of abutments circumferentially spaced from one another about the axis, the plurality of abutments in alternating and circumferentially spaced arrangement with the plurality of frangible bridges, wherein each abutment of the plurality of abutments includes an upwardly directed tamper band bearing surface adjacent and spaced from the sidewall lower end of the main cap body.

In some examples, each bearing surface is spaced from the open sidewall lower end by a spacing distance, the spacing distance at least 0.25 millimeters.

In some examples, the open sidewall lower end includes at least one downwardly directed main cap bearing surface opposite at least one of the plurality of upwardly directed tamper band bearing surfaces across the spacing distance.

According to some aspects, a cap for a container includes a main cap body including an annular sidewall extending along an axis, the annular sidewall having a sidewall upper end adjacent a cap upper end closed by a top panel and a sidewall lower end opposite the top panel, the annular sidewall including a main body shoulder portion adjacent the sidewall lower end, the main body shoulder portion including an axially downwardly directed main body bearing surface; an annular tamper evident band disposed about the axis and adjacent the sidewall lower end, the tamper evident band including a generally rigid cylindrical frame having a frame upper edge frangibly connected to the sidewall lower end by a plurality of frangible bridges spaced apart circumferentially about the axis, the cylindrical frame including a tamper band shoulder portion adjacent the upper edge, the tamper band shoulder portion including an axially upwardly directed tamper band bearing surface, the tamper band bearing surface opposite the main body bearing surface across a separation gap, and an axially downwardly directed mold ejection surface opposite the tamper band bearing surface, and a plurality of retainer elements supported by the cylindrical frame and spaced apart circumferentially about the axis.

In some examples, the tamper band shoulder portion includes a plurality of abutments and the axially upwardly directed tamper band bearing surface includes a plurality of abutment bearing surfaces, each abutment of the plurality of abutments forming an abutment bearing surface of the plurality of abutment bearing surfaces.

In some examples, the plurality of abutments are circumferentially spaced from one another about the axis, and the plurality of abutments are in alternating and circumferentially spaced arrangement with the plurality of frangible bridges.

In some examples, the separation gap is at least 0.25 millimeters.

In some examples, the tamper band shoulder portion further includes a circumferentially continuous ejection ring, the circumferentially continuous ejection ring forming the axially downwardly directed mold ejection surface.

In some examples, the cylindrical frame includes a plurality of ribs circumferentially spaced from one another about the axis and each extending from the frame upper end to the frame lower end, each frangible bridge of the plurality of frangible bridges circumferentially aligned with a rib of the plurality of ribs, the cylindrical frame having a frame inner diameter larger than a neck flange outer diameter of a neck flange, the plurality of retainer elements in alternating arrangement with the plurality of ribs, each retainer element joined at a retainer first end to a first adjacent rib by a first resiliently flexible connecting web and at a retainer second end circumferentially opposite the retainer first end to a second adjacent rib by a second resiliently flexible connecting web, and wherein each retainer element is, by resilient expansion and contraction of the first and second resiliently flexible connecting webs, movable between a contracted position defining a retainer element first inner diameter and an expanded position defining a retainer element second inner diameter, the retainer element first inner diameter less than the neck flange outer diameter for engaging an underside surface of the neck flange when in the contracted position, and the retainer element second inner diameter greater than the neck flange outer diameter when in the expanded position.

In some examples, the cylindrical frame includes an upper ring at the frame upper end and a lower ring at the frame lower end, each rib of the plurality or ribs extending between the upper and lower rings and joining the upper and lower rings together, the lower ring also joined to a retainer element lower end of each retainer element.

In some examples, the retainer element first inner diameter is radially spaced from the frame inner diameter by at least 0.8 millimeters.

In some examples, the retainer element first inner diameter is radially spaced from the frame inner diameter by about 1.25 millimeters.

In some examples, each retainer element further comprises a resiliently flexible upper web joining an axially upper edge of the retainer element to the upper annular portion.

In some examples, the resiliently flexible upper web includes an upper portion and an adjoining lower portion, the upper portion extending axially and the lower portion extending radially when the retainer element is in the expanded position and the upper portion and the lower portion forming an acute angle when the retainer element is in the contracted position.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim, or dedicate to the public any such invention by its disclosure in this document.

Figures 1A, 1B:
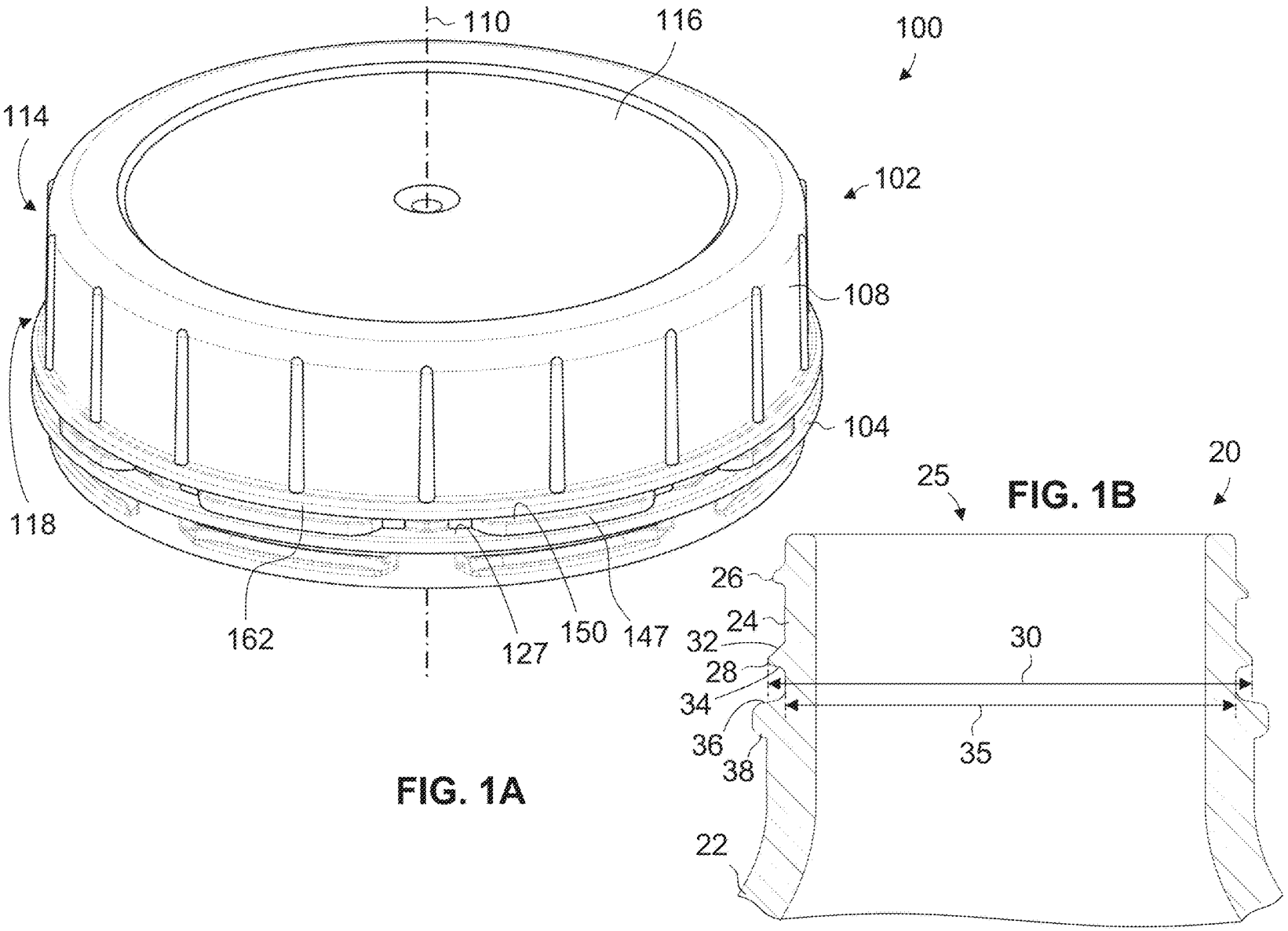
FIG. 1A is a top perspective view of a container cap.
FIG. 1B is a cross sectional view of an upper end of a container.

Referring to FIGS. 1A and 1B, an example of a cap 100 for a container 20 includes a cap main body 102 and an annular tamper evident band 104. The container 20 is representative of a typical container for which the cap 100 can serve as a removable and replaceable closure.

The container 20 includes a container body 22 for holding, for example, liquid contents. The container 20 further includes a neck 24 having a generally hollow tubular form and extending from the container body 22 to an open upper end 25. A portion of the neck adjacent the open upper end is provided with external helical threads 26. An annular flange 28 is provided around the neck 24 at a position below the threads 26 and above the body 22. The annular flange 28 has a flange outer diameter 30 that is, in the example illustrated, slightly greater than the outer diameter of the neck along the external threads 26. The annular flange 28 has a flange upper surface 32 directed toward the open end 25 and a flange underside surface 34 axially opposite the flange upper surface 32. The container 20 further includes a radially outwardly projecting shoulder surface 36 spaced axially below the flange underside surface 34. The shoulder surface 36 extends radially outwardly further than the flange outer diameter 30. In the example illustrated, the shoulder surface 36 comprises an upper surface of a neck bead 38. An axial extent of the neck between the flange underside surface and the shoulder surface defines a lower neck diameter 35 that is less than the flange outer diameter 30, and less than the outer diameter of the external threads 26.

The tamper evident band 104 of the cap 100 is frangibly connected to the cap main body 102. The cap is configured so that when the container is opened for the first time (by unscrewing the cap 100 from the container 20), the frangible connection between the cap main body 102 and the tamper evident band 104 is severed, leaving the band 104 attached to the neck 24 of the container 20 when the cap main body 102 is removed. The severed connection between the body 102 and the band 104 provides visual evidence that the cap main body 102 has been previously removed, even if the cap main body 102 is replaced on the container 20, thus alerting a user or consumer to the possibility of tampering of the container 20 and/or its contents.

As described further herein, the present invention includes various structural features to facilitate performance of the cap. In some examples, this can include features to enhance visibility of the cap having been removed. In some examples, caps according to the teaching described herein include features to facilitate one or more of the following: to help ensure that the band 104 severs completely from the cap main body 102 when first removed; to help ensure that the tamper evident band 104 remains coupled to the container neck 24; and/or to help ensure that upon reinstallation of the cap main body 102, a gap is visible between the band 104 and the cap main body 102.

In the example illustrated, the cap main body 102 is of integral, one piece injection molded construction, and includes an annular sidewall 108 extending along an axis 110. The annular sidewall 108 has a sidewall upper end 114 closed by a top panel 116 and a sidewall lower end 118 opposite the top panel 116. In the illustrated example, the sidewall lower end 118 is open to receive the upper end of the container neck 24 onto which the cap 100 is to be installed. An inner surface of the annular sidewall 108 is provided with internal threads 119 extending helically about the axis 110 to engage with the external threads 26 of the container 20 for removal and re-installation of the cap from and to the container 20.

Figure 2:
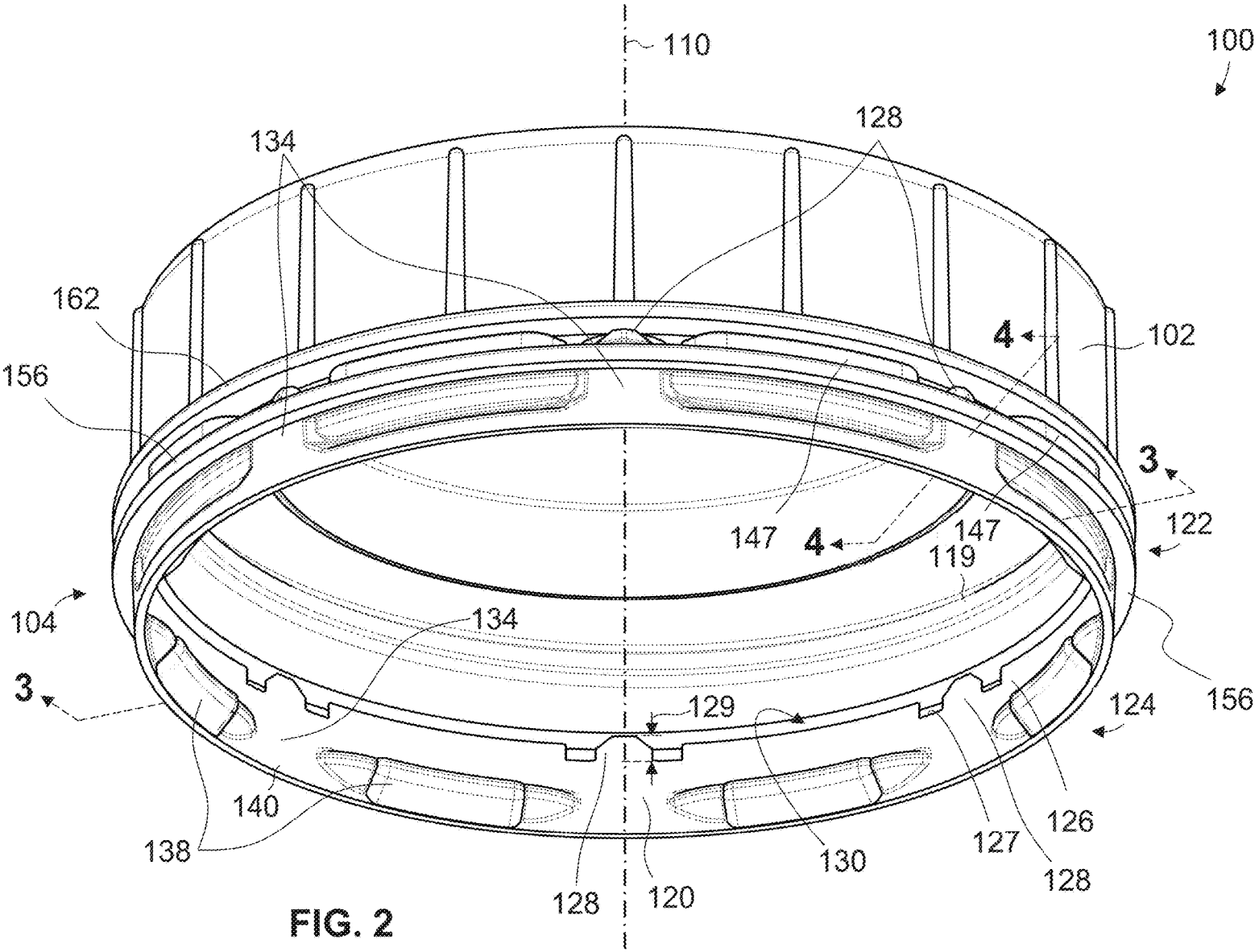
FIG. 2 is a bottom perspective view of the container cap of FIG. 1A.

Referring now to FIG. 2, in the illustrated example, the annular tamper evident band 104 is frangibly connected to the sidewall lower end 118 of the cap main body 102. The tamper evident band 104 includes, in the example illustrated, a generally rigid cylindrical frame 120 and a plurality of retainer elements 138 that are supported by the cylindrical frame 120. When subjected to typical forces in normal use of the cap 100, the retainer elements 138 are moveable relative to the cylindrical frame 120, while members of the cylindrical frame 120 itself remain in generally fixed position (fixed spacing) relative to each other.

In the illustrated example, the tamper evident band 104 is of unitary, one-piece construction, and is formed by injection molding. The band 104 can be injection molded of a different material than the cap main body 102, for example, in a two-shot injection molding process. In the example illustrated, the band 104 and cap main body 102 are of the same material and formed simultaneously in a one-shot injection molding process. The material can be a plastics material, and in the example illustrated, is an HDPE material.

The cylindrical frame 120 includes a frame upper end 122 adjacent the cap main body 102 and a frame lower end 124 spaced axially apart from the frame upper end 122. The frame upper end 122 is frangibly connected to the sidewall lower end 118 of the cap main body 102.

In the example illustrated, the frame upper end 122 includes an upper ring 126 coaxial with the axis, the upper ring 126 having an upper surface 127 directed towards, and frangibly connected to, the sidewall lower end 118 by a plurality of frangible bridges 128. The frangible bridges 128 comprise, in the example illustrated, webs of plastic material oriented generally parallel to the axis 110 and spaced circumferentially apart about the axis 110.

Figure 4:
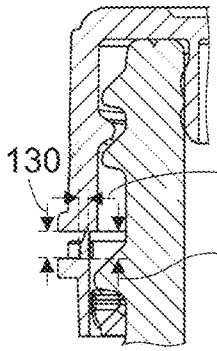
FIG. 4 is a cross-sectional view of the container cap of FIG. 1A, taken along line 4-4 of FIG. 2 and installed on the container of FIG. 1B.
Figure 5:
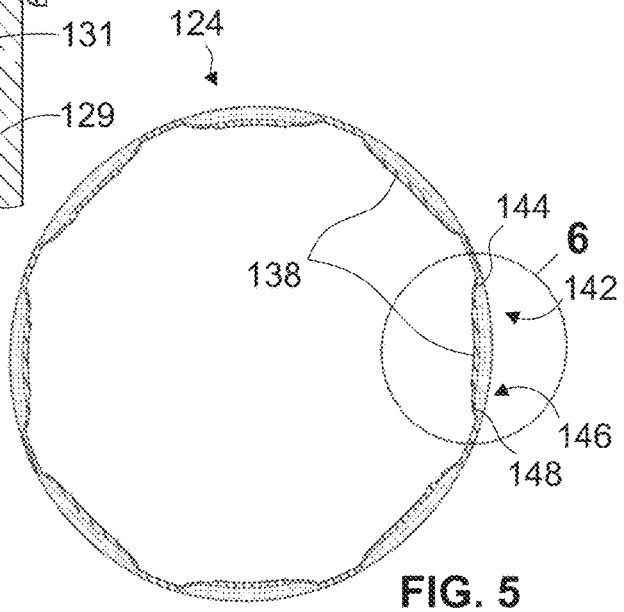
FIG. 5 is a cross sectional-view of the container cap of FIG. 1A, taken along line 5-5 of FIG. 3.

Each bridge 128 has a bridge length 129 that spans an initial band gap 130 extending axially between the sidewall lower end 118 and the upper surface 127 of the upper ring 126. Each bridge 128 has a bridge thickness 131 (FIG. 4) extending radially between inner and outer surfaces. The bridge length 129 and bridge thickness 131 are configured to facilitate a connection between the cap main body 102 and the band 104 that is sufficiently frangible to sever upon initial opening of the container, yet sufficiently strong to remain intact during other times, such as during manufacture and handling of the cap and during first installation of the cap 100 onto the container.

In the example illustrated, the cap 100 includes eight bridges 128 spaced equally apart about the circumference of the cap 100. The bridges 128 each have an axially extending bridge length 129 of about 1.4 mm. At least a portion of each bridge can include features to facilitate severing. In the example illustrated, each bridge 128 includes a thinned portion at an upper end of each bridge, adjacent the connection to the sidewall lower end of the cap main body. In the example illustrated, the thinned portion of each bridge has a radially extending bridge thickness 131 of about 0.18 mm. The bridges 128 are, in the example illustrated, formed integrally with, and in the same injection molding cycle as, the cap main body 102 and tamper evident band 104.

The frame 120 further includes a plurality of ribs 134 extending axially from the upper ring 126 to the frame lower end 124. The upper ring 126 and ribs 134 are considerably stronger than the frangible bridges 128, and in the example illustrated have a thickness that is at least double the bridge thickness 131.

In some examples, the upper ring 126 can have a radially extending thickness between about 0.6 mm and about 2.5 mm. In the example illustrated, the upper ring has a radially extending thickness of about 1.6 mm. The upper ring 126 is, in the example illustrated, generally rectangular in cross-section and has an axial extent of about 1 mm. In some examples, the ribs 134 can have a radially extending wall thickness of between about 0.3 mm and 0.8 mm. In the example illustrated, the ribs 134 have a wall thickness of about 0.5 mm.

In the example illustrated, the frame lower end 124 includes an optional lower ring 140 at a lower end 145 of the ribs 134 and coaxial with the axis 110, and the ribs 134 extend between and connect together the upper and lower rings 126, 140. The lower ring 140 has, in the example illustrated, a radial wall thickness that is about equal to the radial wall thickness of the ribs 134. The upper ring 126, ribs 134, and optional lower ring 140 remain in generally fixed position relative to each other during normal use of the cap 100.

The optional lower ring can have a radially extending wall thickness of between about 0.3 mm and 0.8 mm, and/or can be generally equal to the rib wall thickness. In the example illustrated, the lower ring wall thickness is about 0.5 mm. In the example illustrated, the lower ring 140 is generally rectangular in cross-section and has a lower ring axial extent that is about double the lower ring wall thickness, i.e. about 1 mm.

In the example illustrated, the frame 120 of the annular band 104 includes eight ribs 134 spaced circumferentially about the axis 110. The ribs 134 are, in the example illustrated, optionally aligned with the bridges 128, such that when viewed along the axis 110, each bridge 128 is in registration with a respective rib 134. This circumferential alignment of the bridges 128 and ribs 134 can facilitate desired transfer of force from the band 104 to the bridges 128 as explained furthermore subsequently herein.

In the example illustrated, the frame 120 of the tamper evident band 104 has a frame inner diameter 136 (FIG. 3) sized greater than the flange outer diameter 30 of the neck flange 28 of the container 20. This can help ensure that the frame 120 does not impede axial displacement of the tamper evident band 104 past the neck flange 28, for example, during assembly of the cap onto the container. In some examples, the frame inner diameter 136 can be sized to provide a radial gap 137—also referred to as a "drop gap" 137 (see FIG. 9) between the outer surface of the neck flange 28 and the inner surface of the frame 120 of at least about 0.1 mm. This can advantageously promote axial displacement (or dropping) of the band 104 away from the flange 28 after the frangible bridges have been severed. The inventors have discovered that limiting the size of the radial gap to, for example, less than about 0.3 mm can help ensure desired engagement of the retainer elements 138 with the underside surface of the flange 28. In the example illustrated, the frame inner diameter 136 is about 0.3 mm greater than the flange outer diameter 30, providing a radial gap 137 of about 0.15 mm.

In some examples, the ribs 134 have radially inner surfaces that define a rib inner diameter 190. The lower ring generally has an inner surface that defines a lower ring inner diameter 188. The frame inner diameter 136 is generally defined to be the smallest inner diameter defined by actual members of the frame 120 itself. In the illustrated example, the rib inner diameter 190 is equal to frame inner diameter 136. In the illustrated example, the lower ring inner diameter 188 is equal to the frame inner diameter 136.

Figure 3:
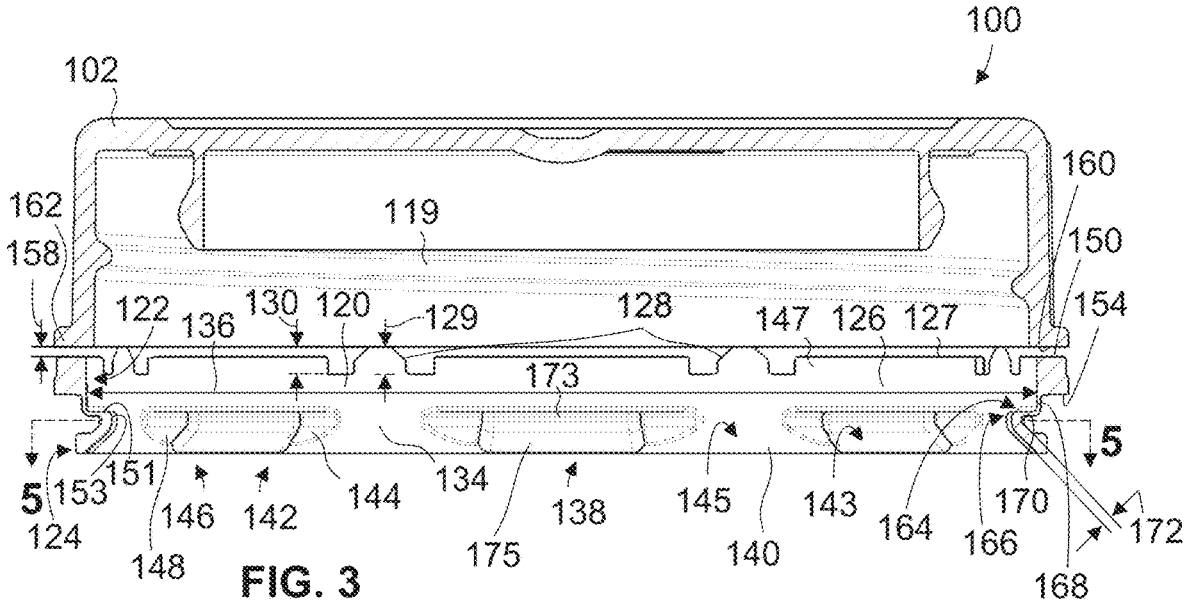
FIG. 3 is a cross-sectional view of the container cap of FIG. 1A, taken along line 3-3 of FIG. 2.

With reference also to FIG. 3, the tamper evident band 104 includes a plurality of retainer elements 138 that are supported by the cylindrical frame 120. In the example illustrated, the band 104 includes eight retainer elements 138. The retainer elements 138 are circumferentially spaced from one another about the axis 110 in alternating arrangement with the plurality of ribs 134, so that each retainer element 138 is disposed between a pair of circumferentially adjacent ribs 134 (each pair of ribs 134 including a first adjacent rib and a second adjacent rib).

Still referring to FIG. 2, in the example illustrated, each retainer element 138 comprises a tab of plastic material generally positioned axially below the upper ring 126 and circumferentially between adjacent ribs 134. The retainer elements 138 are biased to a contracted position in which retainer element upper surfaces 151 of the retainer elements 138 protrude radially inward of the frame inner diameter 136 and radially inward of the container neck flange outer diameter 30. The retainer upper surfaces 151 have radially inner edges 153 that, when the retainer elements are in the contracted position, are spaced generally circumferentially apart along a retainer first (contracted) diameter. The contracted diameter is less than the flange outer diameter 30, and greater than the lower neck diameter 35 of the container neck below the flange 28.

The retainer upper surface 151 is generally orthogonal to axis 110 at least when in the contracted position (see for example FIG. 3, left side), and is generally axially fixed relative to the frame 120 at least when in the contracted position. Each retainer element 138 has, in the example illustrated, a lower inclined surface that extends between an incline upper end and an incline lower end. The incline upper end is axially below, and at generally the same radial distance from the axis 110 as, the inner edge of the upper surface 151. The incline lower edge generally coincides axially with the frame lower end, and is at the same radial distance from the axis as the inner diameter surface of the frame 120.

Each retainer element has an intermediate inclined surface opposite the lower inclined surface, forming an inclined wall that extends axially upward and radially inward form the lower ring 140 to the inner end of the retainer upper surface. The inclined wall has an inclined wall thickness (defining a retainer thickness 172) extending between the opposed inclined surfaces that is, in the example illustrated, about 0.55 mm.

Referring now to FIGS. 3 to 6, to facilitate supporting the retainer elements 138 by the frame 120, each retainer element 138 has circumferentially opposed retainer first and retainer second ends 142, 146. The retainer first end 142 is joined to a first adjacent rib 134 (of the pair of ribs 134 between which the retainer element 138 is located) by a first resiliently flexible connecting web 144. The retainer second end 146 is joined to the other, second adjacent rib 134 by a resiliently flexible second end connecting web 148.

In the illustrated example, the first and second resiliently flexible connecting webs 144, 148 have a web thickness 171. In some examples, the web thickness 171 is about 0.23 mm. In some examples, the web thickness 171 facilitates flexing and/or stretching of the first and second resiliently flexible connecting webs 144, 148. In some examples, flexing and/or stretching facilitates radial movement of the retainer segment 138 relative to one or more of the ribs 134.

Figure 6:
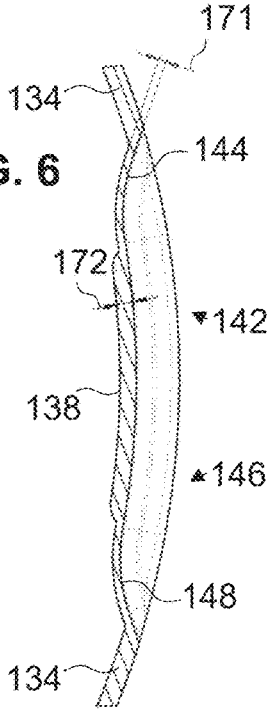
FIG. 6 is an enlarged view of the portion of FIG. 5 within the circle marked at "6"

In some examples, the retainer element 138 has a retainer element thickness 172 (see FIG. 3, FIG. 6). In some examples, the retainer element thickness 172 is about 0.5 mm. In some examples, the retainer element thickness 172 is at least twice the web thickness 171. In some examples, the retainer element thickness 172 facilitates spring-back of the retainer segments 138. In some examples, a lower portion 175 of a retainer element is thicker than an upper portion 173 of a retainer segment 138. In some examples, the lower portion 175 is about 0.55 mm thick and the upper portion 173 is about 0.5 mm thick.

In the illustrated example, each retainer element 138 is further connected to the frame by a resiliently flexible upper web 164 joining an axially upper edge 166 of the retainer element 138 to a lower surface of the upper ring. In some examples, the resiliently flexible upper web 164 has the same web thickness 171 as the first and second resiliently flexible connecting webs 144, 148.

In the illustrated example, the resiliently flexible upper web 164 includes an upper portion 168 and an adjoining lower portion 170. In some examples, the resiliently flexible upper web 164 has separate upper and lower portions 168, 170 to facilitate movement between the separate upper and lower portions 168, 170. In the example illustrated, the lower portion 170 extends radially when the resiliently flexible upper web 164 is in the contracted position (FIG. 7), and is generally coplanar with, and forms part of, the retainer element upper surface 151. In some examples, a radial extension of the lower portion 170 facilitates retaining the tamper evident band 104 on a container when the cap main body 102 is removed.

Each retainer element can further be connected to the lower ring 140. In the example illustrated, a lower end 143 of the inclined wall is directly connected to the generally vertically (axially) oriented inner surface of the lower ring. The absence of a flexible connecting web between the lower end 143 of the retainer element and the lower ring does not hinder movement of the retainer element, as portions of the lower ring between adjacent ribs are able to twist slightly while remaining in position (i.e. without displacement relative to the ribs).

In the illustrated example, the frame upper end 122 includes a plurality of abutments 147 circumferentially spaced from one another about the axis 110. The plurality of abutments 147 are, in the example illustrated, provided on the upper surface 127 of the upper ring 126 in alternating and circumferentially spaced arrangement with the plurality of frangible bridges 128. Each abutment 147 of the plurality of abutments 147 includes an upwardly directed tamper band bearing surface 150 directed towards the sidewall lower end 118 of the cap main body 102. Each abutment 147 has an abutment height extending between the upper surface 127 of the upper ring 126 and the bearing surface 150 of the abutment 147 (see FIG. 1A).

The abutment axial height is generally sized to position the bearing surface 150 axially near, but spaced slightly apart from, the sidewall lower end 118, so that in cases where a compressive force urges the cap main body 102 and band 104 axially towards each other, the relative axial displacement is limited by engagement of the bearing surfaces 150 and the sidewall lower end 118. For example, the abutment height of the abutments 147 can be in the range of about 30 percent to about 95 percent of the initial band gap 130. In the example illustrated, the abutment height is between about 60 percent and about 70 percent of the initial band gap 130, leaving a clearance gap 158 between the sidewall lower end 118 of the cap main body 102 and the bearing surface 150 that is between about 30 percent and about 40 percent of the initial band gap 130. In some examples, the clearance gap 158 is about 0.25 mm.

Limiting the axial displacement can help to reduce the risk of unintended severing of the frangible bridges 128 during compression forces exerted, for example, during initial installation of the cap 100 onto the container, or during ejection of the cap 100 from a mold after forming the cap 100, In the illustrated example, the sidewall lower end 118 of the cap main body 102 includes at least one downwardly directed main cap bearing surface 160 for engaging the tamper band bearing surface 150 when the cap main body 102 and tamper band 104 are compressed axially towards each other. In the example illustrated, the at least one downwardly directed main cap bearing surface 160 is a surface of a main body shoulder portion 162 of the cap main body 102 adjacent the sidewall lower end 118.

In some examples, the cap 100 includes one or more discrete axially downwardly directed mold ejection surfaces 154. Each mold ejection surface 154 is accessible by an ejection member advanced axially in a direction from beneath the tamper evident band 104 towards the cap main body 102. This can be facilitated, for example, by configuring the ejection surface 154 to protrude radially outward further than any other surface of the cap 100 along the axial extent of the cap 100 between the ejection surfaces 154 and the lowermost end of the tamper evident band 104. In the example illustrated, the ejection surface 154 is axially fixed to the tamper evident band 104. In the example illustrated, the ejection surface 154 comprises an annular portion 156 (FIG. 2) of the underside surface of the upper ring 126, that projects radially outwardly past the ribs 134 and past the outer diameter of the lower ring 140.

Figure 7:
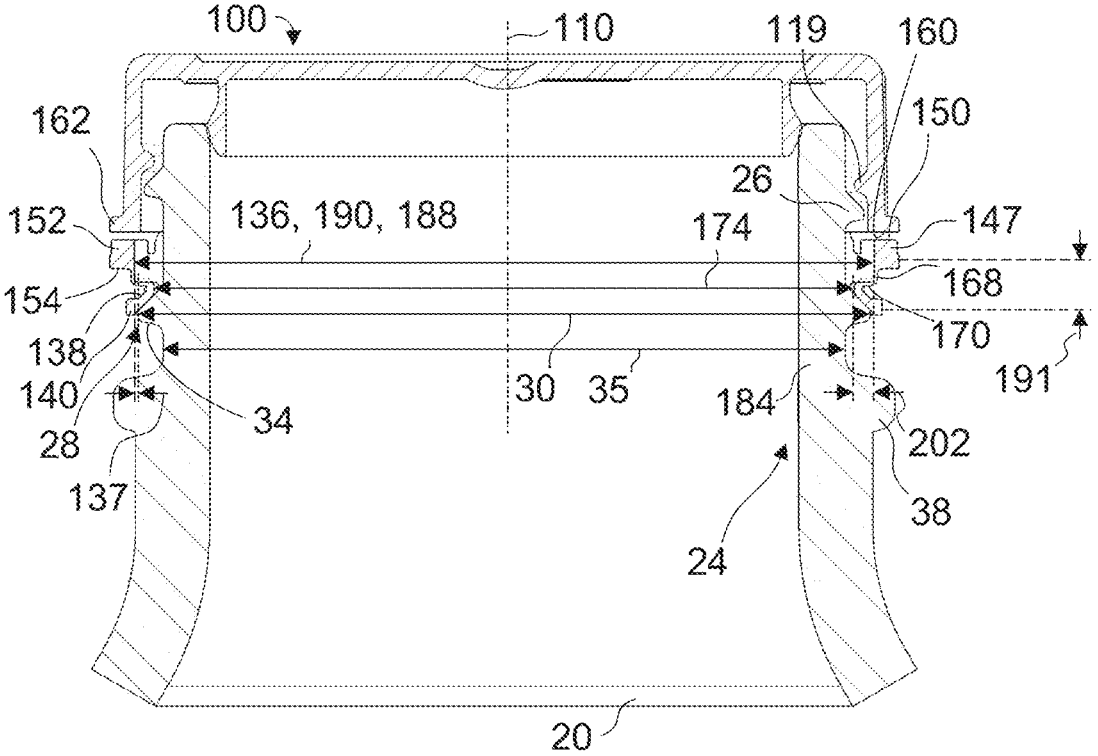
FIG. 7 is a cross-sectional view of the container cap of FIG. 1A in a first partially installed condition on the container of FIG. 1B.
Figure 8:
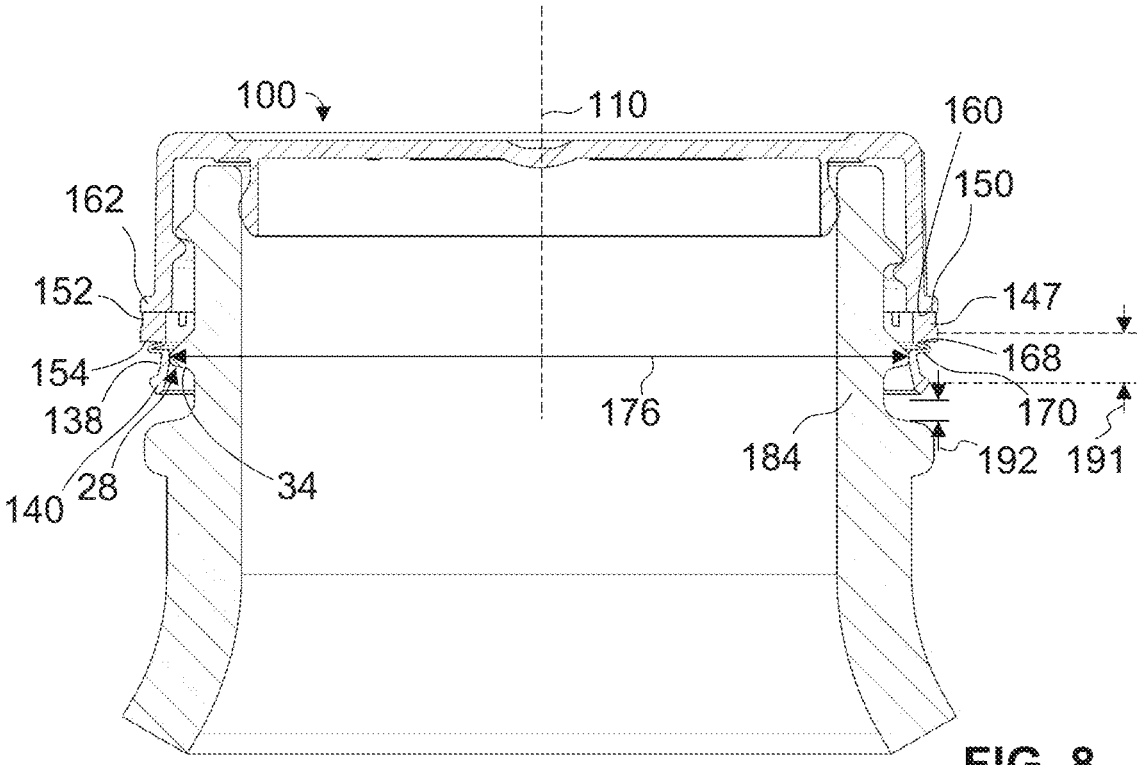
FIG. 8 is a cross sectional view of the container cap of FIG. 1A in a second and further partially installed condition on the container of FIG. 1B.

Referring to FIGS. 7 and 8, the retainer elements 138 are biased to the contracted position (FIG. 7), and movable to an expanded position (FIG. 8) in which the retainer elements 138 are moved radially outward. When in the expanded position, the radially inner edges of the retainer elements 138 are generally spaced from each other across the axis 110 by an amount defining a second, expanded diameter 176. The expanded diameter 176 is generally equal to or slightly larger than the flange outer diameter 30 so that the retainer elements 138 can be urged axially past the flange 28 in sliding fit.

In use, when first installing the cap 100, the cap is advanced axially over the container neck. The axial advance can be effected by turning the cap with the cap threads engaging the neck threads. In some cases, the initial installation of the cap can be performed by equipment that pushes the cap over the neck without turning.

As the cap is advanced axially onto the neck, the retainer elements are pushed from the collapsed position (FIG. 7) to the expanded position (FIG. 8). In the example illustrated, the bottom surface of each retainer element engages the upper surface of the neck flange. This contact results in resistance to further axial advancement of the tamper band 104 while installation of the cap main body continues. This can reduce the initial band gap 130 between the main body 102 and the band 104, and place the frangible webs 128 in compression. The abutments 147 on the upper surface 127 of the upper ring 126 limit the reduction of the initial gap 130, as engagement of the upper surface 150 of the abutments 147 with the lower surface of the sidewall lower edge inhibits further displacement of the cap main body 102 toward, and relative to, the tamper band 104.

With sufficient axial force exerted on the tamper band 104, the biasing force holding the retainer elements in the contracted positon can be overcome, and move the retainer elements 138 to the expanded position. This radial movement of the retainer elements can be facilitated by providing the lower surface of the retainer elements on an incline, such that a portion of the axial force between the retainer elements and the neck flange is resolved to a radially outwardly directed force on the retainer elements.

When in the expanded position, the flexibly resilient web connectors are stretched within their elastic limit. Furthermore, in the example illustrated, the optional lower ring 140 can twist slightly along the portions connected to the lower end of the retainer elements.

Figure 9:
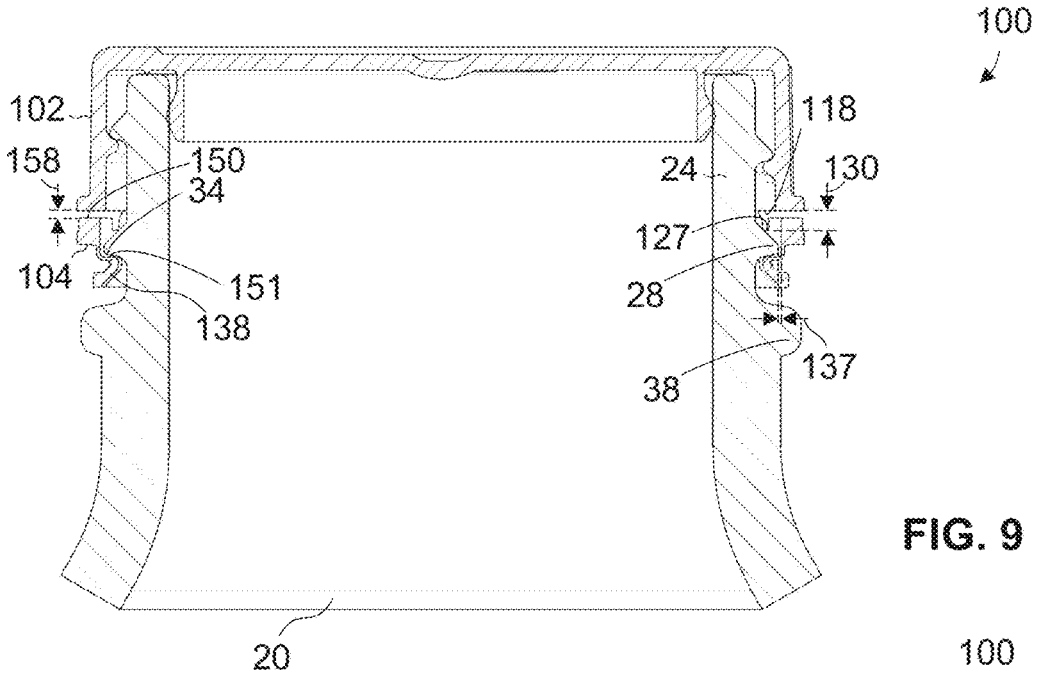
FIG. 9 is a cross-sectional view of the container cap of FIG. 1A fully installed onto the container of FIG. 1B.
Figure 10:
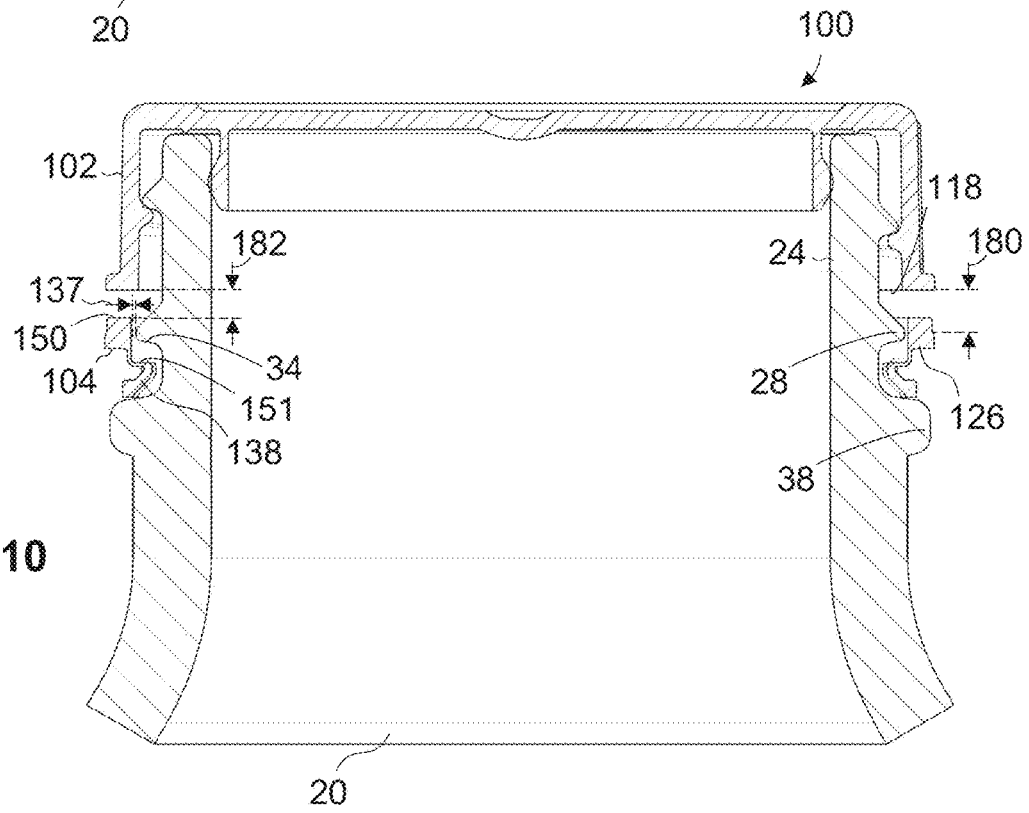
FIG. 10 is a cross-sectional view of the container cap of FIG. 1A with the cap main body replaced in its fully installed position on the container of FIG. 1B and the tamper evident band severed from and dropped away from the cap main body.

Referring now to FIG. 9 and FIG. 10, when the cap 100 is axially advanced to the fully closed positon (FIG. 9), the retainer elements 138 are moved axially past the neck flange 28, and the retainer elements 138 then move to the contracted positon. Movement to the contracted position is facilitated by the biasing force exerted by the connecting webs (i.e. as the connecting webs relax or un-stretch or un-compress) 144, 148, 164, and, optionally, by untwisting of the lower ring 140. Once in the contracted position, the upper surfaces 151 of the retainer elements are beneath, and facing the underside surface of, the neck flange 28.

Upon opening the container 20 for the first time, the cap 100 is unscrewed, urging the cap 100 to advance axially away from the container 20. The tamper evident band 104 is inhibited from advancing axially with the cap main body 102, owing to the abutment of the upper surfaces 151 of the retainer elements 138 against the underside surface 34 of the neck flange 28. The orthogonal orientation of the retainer element upper surface 151 can help inhibit the retainer elements 138 from moving toward the expanded position when urged upwardly against the flange underside surface 34. The upward movement of the cap main body 100 relative to the axially fixed tamper band 104 exerts a tensile force on the frangible bridges 128, severing the bridges 128 and allowing the cap main body 102 to be removed from the container neck 24. The tamper evident band 104 then drops downward away from the neck flange 28 under the force of gravity.

Reinstallation of the cap main body 102 is possible by engaging the threads and turning the cap main body 102 relative to the container 20. Once fully tightened, the cap main body 102 is returned to its initial (fully installed) axial position (FIG. 10). But the severed bridges 128 provide evidence that the cap main body 102 has previously been removed. Also, the axial displacement of the band 104 away from the neck flange 28 provides additional—and readily visible—evidence that the cap has been previously removed.

A final band gap 180 (FIG. 10) extending axially between the sidewall lower end 118 and the upper surface 127 (not shown in FIG. 10) of the upper ring 126 is larger than the initial band gap 130 (FIG. 9) extending axially between the sidewall lower end 118 and the upper surface 127 of the upper ring 126. In some examples, the final band gap 180 may be more than twice the initial band gap 130. Similarly, a visibility gap 182 (FIG. 10) between the sidewall lower end 118 of the cap main body 102 and the bearing surface 150 is larger than the clearance gap 158 (FIG. 9) between the sidewall lower end 118 of the cap main body 102 and the bearing surface 150. In some examples, the visibility gap 182 may be more than twice the clearance gap 158.

Referring again to FIGS. 7 and 8, in the illustrated example each retainer segment 138 is movable between a contracted position (shown in FIG. 7) defining a retainer element first inner diameter 174 and an expanded position (shown in FIG. 8) defining a retainer element second inner diameter 176.

In the example illustrated, the retainer element first inner diameter 174 is less than the neck flange outer diameter 30. In some examples, the retainer element first inner diameter 174 is less than the neck flange outer diameter 30 for engaging an underside surface 34 of the neck flange 28 when in the contracted position. In some examples, the retainer element second inner diameter 176 is greater than the neck flange outer diameter 30 when in the expanded position. In some examples, when the retainer elements 138 are in the expanded position the cap 100 can be assembled to the container 20. In some examples, when the retainer segments 138 are in the contracted position the tamper band 104 is captured on the neck 24 of the container 20 below the neck flange 28 and above a lower neck member 38. In some examples, a separation distance 191 between an axial midpoint of the lower ring 140 and an axial midpoint of the frame upper end 122 is the same in the contracted position as in the expanded position.

In some examples, each retainer segment 138 is moveable between the contracted position and the expanded position by resilient expansion and contraction of the first and second resiliently flexible connecting webs 144, 148. In some examples, each retainer segment 138 is moveable between the contracted position and the expanded position by resilient expansion and contraction of the first and second resiliently flexible connecting webs 144, 148 and the resiliently flexible upper web 164. In some examples, each retainer segment 138 is moveable between the contracted position and the expanded position by resilient expansion and contraction of the first and second resiliently flexible connecting webs 144, 148 and the resiliently flexible upper web 164 and bending of the retainer segment 138 and/or twisting of the lower ring 140.

In the illustrated example, the upper portion 168 of each resiliently flexible upper web 164 extends axially and the lower portion 170 extends radially when the retainer elements is in the expanded position and the upper portion 168 and the lower portion 170 form an acute angle when the retainer elements is in the contracted position.

In some examples, the frame inner diameter 136 is greater than the neck flange outer diameter 30, which can facilitate axial displacement or dropping of the tamper band 104 when separated from the cap main body, relative to its initial position when still attached to the cap main body 102. In some examples, a system of container 20 and cap 100 includes a drop distance 192 that the tamper band 104 can fall when separated from the cap main body 102. In some examples, the drop distance 192 facilitates visual confirmation that the cap 100 has been removed from the container 20. In some examples, a neck lower portion 184 has a neck lower portion outer diameter 35. In some examples, the neck lower portion outer diameter 35 is smaller than the retainer element first inner diameter 174 to facilitate the tamper band 104 to drop when separated from the cap main body 102.

In some examples, the presence of the drop gap 137 can increase risk that the tamper band 104 may be removed from the container neck 24 along with the cap main body 102, for example, by tilting the cap 100 relative to the axis 110 during removal. This risk of removal of the tamper evident band 104 from the container is, in the example illustrated, counteracted by increasing the radial extent 202 of the upper surface 151 of the retainer elements 138. For example, the radial extent of the retainer upper surface, when in the contracted position, extends between an inner surface of the frame (defining the frame inner diameter 136) and the retainer inner edge 153. This radial extent 202 (also called "snap depth" 202) is, in some examples according to the present teaching, at least 0.8 millimeters. In the example illustrated, the snap depth 202 is about 1.25 millimeters.

Figure 11:
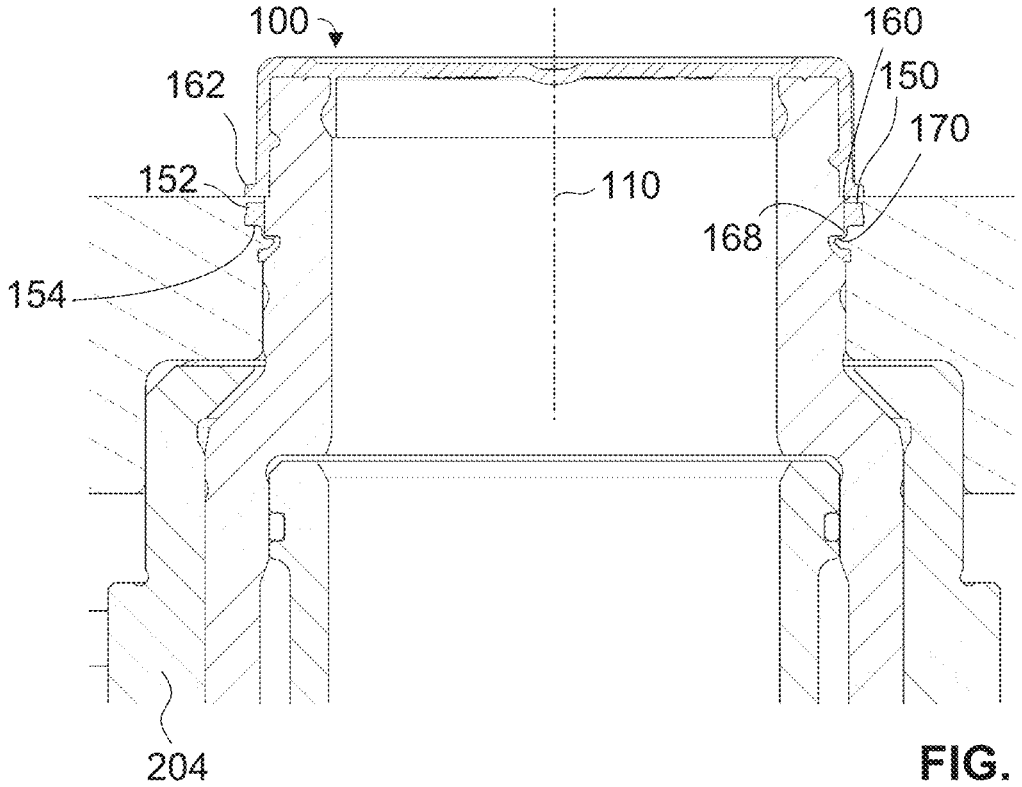
FIG. 11 is a cross-sectional view of the container cap of FIG. 1A in a mold for forming the cap by injection molding.
Figure 12:
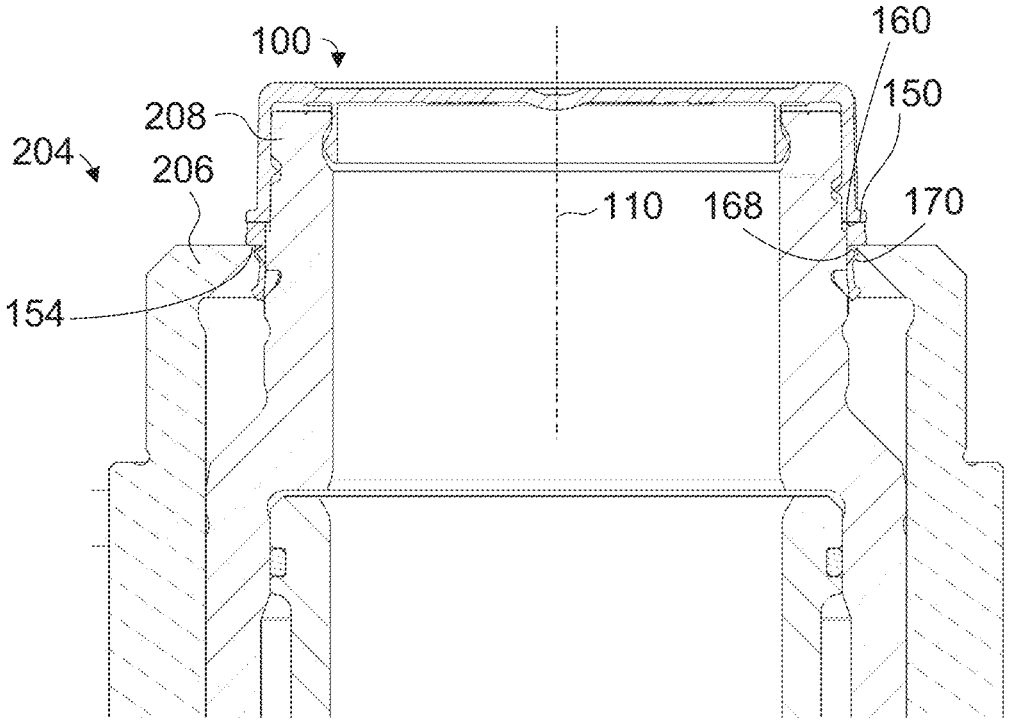
FIG. 12 is a cross-sectional view of the container cap of FIG. 1A partially removed from the mold of FIG. 11.

Referring now to FIGS. 11 and 12, in some examples the cap 100 is a plastic cap. In some examples, cap 100 is formed in a mold 204 by injection molding. In the illustrated example, the mold 204 includes a stripper member 206 to eject the cap 100 from the mold 204 when at the end of the injection and cooling steps.

In some examples, removing the cap 100 from the mold is facilitated by the web structure of the cap 100. In some examples, removing the cap 100 from a mold is facilitated by the first and second resiliently flexible connecting webs 144, 148 and/or the resiliently flexible upper web 164. In the example illustrated, the cap is formed with the retainer elements in the radially contracted position, and the retainer elements are movable to a demolding position to facilitate removing the cap from the mold. The demolding position is, in the example illustrated, a third position of the retainer elements, different than the radially expanded positon and different than the radially contracted position. In the example illustrated, the retainer elements are at a radially position that is generally equal to, or outboard of, the frame inner diameter 136 when in the demolding position.

In some examples, the stripper member 206 engages the axially downwardly directed mold ejection surface 154. In the illustrated example, the stripper member 206 engages a single circumferentially continuous mold ejection surface 154, however in some examples the stripper member 206 engages two or more discrete mold ejection surfaces 154. In the illustrated example, the stripper member 206 engages the circumferentially continuous mold ejection surface 154 around the entire circumference, however in some examples the stripper member 206 engages the mold ejection surface 154 at two or more discrete locations on the circumferentially continuous mold ejection surface 154.

In some examples, the stripper member 206 pushes the axially downwardly directed mold ejection surface 154 axially upwards. In some examples, providing the mold ejection surface 154 on the tamper band 104 prevents the frangible bridges from being stretched during ejection. In some examples, the stripper member 206 pushes the axially downwardly directed mold ejection surface 154 axially upwards and pushes the tamper band shoulder portion 152 into contact with the main body shoulder portion 162.

In some examples, providing one or more mold ejection surfaces 154 only on the tamper band 104 and only above the retainer elements 138 reduces stress on one or more of the frangible bridges 128 and the retainer elements 138 during ejection from a mold.

In some examples, axially upward movement of the mold ejection surface 154 pushes the upwardly directed tamper band bearing surfaces 150 closer to the downwardly directed main cap bearing surface 160. In the illustrated example, the upwardly directed tamper band bearing surfaces 150 bears on the downwardly directed main cap bearing surface 160 when the stripper member 206 engages the axially downwardly directed mold ejection surface 154 (FIG. 12). In some examples, the frangible bridge 128 are compressed when the stripper member 206 engages the axially downwardly directed mold ejection surface 154. In some examples, compression of the frangible bridge 128 protects the frangible bridge 128 from breaking.

In some examples, providing the mold ejection surface 154 on the tamper band 104 above the retainer elements 138 causes the retainer elements 138 to be pulled axially upwards off of a mold tooling 208 rather than being pushed axially upwards off of the mold tooling 208 from below. In some examples, providing the mold ejection surface 154 on the tamper band 104 above the retainer elements 138 reduces stress on the retaining features during an ejection process. In some examples, pushing the retainer elements 138 upwards off of a mold tooling 208 stresses the retainer elements 138 in part due to the radial extension of the lower portion 170 of the resiliently flexible upper web 164.

The invention claimed is:

1. A cap for a container, comprising:

a) a main cap body including an annular sidewall extending along an axis, the annular sidewall having a sidewall upper end adjacent a cap upper end closed by a top panel and a sidewall lower end adjacent a cap lower end opposite the top panel; and b) an annular tamper evident band disposed about the axis and adjacent the sidewall lower end, the tamper evident band including:

a generally rigid cylindrical frame having:

an upper ring at a frame upper edge frangibly connected to the sidewall lower end by a plurality of frangible bridges spaced apart circumferentially about the axis;

a plurality of ribs circumferentially spaced from one another about the axis and extending from the upper ring to a frame lower end opposite the frame upper end, each frangible bridge of the plurality of frangible bridges circumferentially aligned with a rib of the plurality of ribs; and the generally rigid cylindrical frame having a frame inner diameter larger than a neck flange outer diameter of a neck flange;

a plurality of retainer elements circumferentially spaced from one another about the axis in alternating arrangement with the plurality of ribs, each radially inwardly directed retainer element joined at a retainer first end to a first adjacent rib by a first resiliently flexible connecting web and at a retainer second end circumferentially opposite the retainer first end to a second adjacent rib by a second resiliently flexible connecting web; and wherein each retainer element is, by resilient expansion and contraction of the first and second resiliently flexible connecting webs, movable between a contracted position defining a retainer element first inner diameter and an expanded position defining a retainer element second inner diameter, the retainer element first inner diameter less than the neck flange outer diameter for engaging an underside surface of the neck flange when in the contracted position, and the retainer element second inner diameter greater than the neck flange outer diameter when in the expanded position.

2. The cap of claim 1, wherein the generally rigid cylindrical frame includes a lower ring extending about the circumference, each rib of the plurality of ribs extending from the upper ring to the lower ring to join the upper and lower rings together, the lower ring also joined to a lower end of each retainer element.

3. The cap of claim 1, wherein the retainer element first inner diameter is radially spaced from the frame inner diameter by at least 0.8 millimeters.

4. The cap of claim 1, wherein each retainer element further comprises a resiliently flexible upper web joining an axially upper edge of the retainer element to the upper ring.

5. The cap of claim 4, wherein the resiliently flexible upper web of each respective retainer element to which it is attached includes an upper portion and an adjoining lower portion, the upper portion extending axially and the lower portion extending radially when the respective retainer element is in the expanded position and the upper portion and the lower portion forming an acute angle when the respective retainer element is in the contracted position.

6. The cap of claim 1, wherein the generally rigid cylindrical frame includes a plurality of abutments at the frame upper end, the plurality of abutments circumferentially spaced from one another about the axis, the plurality of abutments in alternating and circumferentially spaced arrangement with the plurality of frangible bridges, wherein each abutment of the plurality of abutments includes an upwardly directed tamper band bearing surface adjacent and spaced from the sidewall lower end of the main cap body.

7. The cap of claim 6, wherein each tamper band bearing surface is spaced from the sidewall lower end by a spacing distance, the spacing distance at least 0.25 millimeters.

8. The cap of claim 7, wherein the sidewall lower end includes at least one downwardly directed main cap bearing surface opposite at least one of the plurality of upwardly directed tamper band bearing surfaces across the spacing distance.

9. A cap for a container, comprising:

a) a main cap body including an annular sidewall extending along an axis, the annular sidewall having a sidewall upper end adjacent a cap upper end closed by a top panel and a sidewall lower end opposite the top panel, the annular sidewall including: a main body shoulder portion adjacent the sidewall lower end, the main body shoulder portion including an axially downwardly directed main body bearing surface;

b) an annular tamper evident band disposed about the axis and adjacent the sidewall lower end, the tamper evident band including:

a generally rigid cylindrical frame having a frame upper edge frangibly connected to the sidewall lower end by a plurality of frangible bridges spaced apart circumferentially about the axis, the generally rigid cylindrical frame including a tamper band shoulder portion adjacent the upper edge, the tamper band shoulder portion including an axially upwardly directed tamper band bearing surface, the tamper band bearing surface opposite and spaced apart from the main body bearing surface by a separation gap, and the generally rigid cylindrical frame including an axially downwardly directed mold ejection surface opposite the tamper band bearing surface; and a plurality of retainer elements supported by the generally rigid cylindrical frame and spaced apart circumferentially about the axis.

10. The cap of claim 9, wherein the tamper band shoulder portion includes a plurality of abutments and the axially upwardly directed tamper band bearing surface includes a plurality of abutment bearing surfaces, each abutment of the plurality of abutments forming an abutment bearing surface of the plurality of abutment bearing surfaces.

11. The cap of claim 10, wherein the plurality of abutments are circumferentially spaced from one another about the axis, and the plurality of abutments are in alternating and circumferentially spaced arrangement with the plurality of frangible bridges.

12. The cap of claim 11, wherein the separation gap is at least 0.25 millimeters.

13. The cap of claim 11, wherein the tamper band shoulder portion further includes a circumferentially continuous ejection ring, the circumferentially continuous ejection ring forming the axially downwardly directed mold ejection surface.

14. The cap of claim 9, wherein the generally rigid cylindrical frame includes:

a) a plurality of ribs circumferentially spaced from one another about the axis and each extending from the frame upper end to the frame lower end, each frangible bridge of the plurality of frangible bridges circumferentially aligned with a rib of the plurality of ribs, the generally rigid cylindrical frame having a frame inner diameter larger than a neck flange outer diameter of a neck flange;

b) the plurality of retainer elements in alternating arrangement with the plurality of ribs;

c) each retainer element joined at a retainer first end to a first adjacent rib by a first resiliently flexible connecting web and at a retainer second end circumferentially opposite the retainer first end to a second adjacent rib by a second resiliently flexible connecting web; and d) wherein each retainer element is, by resilient expansion and contraction of the first and second resiliently flexible connecting webs, movable between a contracted position defining a retainer element first inner diameter and an expanded position defining a retainer element second inner diameter, the retainer element first inner diameter less than the neck flange outer diameter for engaging an underside surface of the neck flange when in the contracted position, and the retainer element second inner diameter greater than the neck flange outer diameter when in the expanded position.

15. The cap of claim 14, wherein the generally rigid cylindrical frame includes an upper ring at the frame upper end and a lower ring at the frame lower end, each rib of the plurality of ribs extending between the upper and lower rings and joining the upper and lower rings together, and the lower ring joined to a retainer element lower end of each retainer element.

16. The cap of claim 14, wherein the retainer element first inner diameter is radially spaced from the frame inner diameter by at least 0.8 millimeters.

17. The cap of claim 14, wherein each retainer element further comprises a resiliently flexible upper web joining an axially upper edge of the retainer element to the upper annular portion.

18. The cap of claim 17, wherein the resiliently flexible upper web of each respective retainer element to which it is attached includes an upper portion and an adjoining lower portion, the upper portion extending axially and the lower portion extending radially when the respective retainer element is in the expanded position and the upper portion and the lower portion forming an acute angle when the respective retainer element is in the contracted position.

19. A cap for a container, the cap including a tamper evident band frangibly connected to a main cap body, the tamper evident band comprising:

a) a generally rigid cylindrical frame disposed about an axis, the generally rigid cylindrical frame having an upper ring proximate the main cap body, a lower ring spaced apart from the upper ring and having a lower ring internal diameter, and a plurality of ribs extending axially between, and joining together, the upper ring and the lower ring, the plurality of ribs spaced circumferentially apart about the axis;

b) a plurality of retainer elements supported by the generally rigid cylindrical frame, each retainer element connected at circumferentially opposed ends by resiliently flexible webs to adjacent ones of the plurality of ribs, and each retainer element having a lower end joined to the lower ring; and wherein the plurality of retainer elements are biased to a radially contracted position, in which the plurality of retainer elements protrude radially inwardly of the lower ring internal diameter to engage an underside surface of a neck flange of the container, and the plurality of retainer elements are movable to a radially expanded position when urging the plurality of retainer elements axially past the neck flange when installing the cap onto the container for the first time.

20. The cap of claim 19, wherein each retainer element has an upper edge connected to the upper ring by a resiliently flexible upper web.

* * * * *